United States Patent [19]

Peters

[11] Patent Number: 4,904,217

[45] Date of Patent: Feb. 27, 1990

[54] VACUUM TUBE INCLUDING AN ELECTRON-OPTICAL SYSTEM

[75] Inventor: Petrus J. M. Peters, Eindhoven, Netherlands

[73] Assignee: U.S. Philips Corporation, New York, N.Y.

[21] Appl. No.: 355,719

[22] Filed: May 22, 1989

Related U.S. Application Data

[62] Division of Ser. No. 156,376, Feb. 16, 1988, Pat. No. 4,853,586.

[30] Foreign Application Priority Data

Feb. 27, 1987 [NL] Netherlands ..... 8700487

[51] Int. Cl.[4] ..... H01J 9/18

[52] U.S. Cl. ..... 445/34; 445/36

[58] Field of Search ..... 445/33, 34, 36

[56] References Cited

U.S. PATENT DOCUMENTS

| | | | |
|---|---|---|---|
| 2,938,134 | 5/1960 | Levin | 313/444 |
| 4,499,402 | 2/1985 | van der Heijden | 445/34 |
| 4,551,648 | 11/1985 | Gange | 313/456 X |
| 4,717,855 | 1/1988 | Zwier et al. | 313/409 |

*Primary Examiner*—Kenneth J. Ramsey
*Attorney, Agent, or Firm*—John C. Fox

[57] ABSTRACT

By using micro-connection techniques, for example by means of ceramic glass and conducting glass, an electron-optical system can be manufactured with which the emitted beam can be deflected through 90° within a very short distance (of the order of several mm).

9 Claims, 3 Drawing Sheets

VACUUM TUBE INCLUDING AN ELECTRON-OPTICAL SYSTEM

CROSS-REFERENCE TO RELATED APPLICATION

This is a division of application Ser. No. 156,376, filed Feb. 16, 1988 now U.S. Pat. No. 4,853,586. U.S. patent application Ser. No. 156,491, filed simultaneously herewith, relates to a vacuum tube in which an electron beam is deflected 90° over a very short distance.

BACKGROUND OF THE INVENTION

The invention relates to a vacuum tube provided with at least one semiconductor cathode having an emissive surface for emitting electrons and an electron-optical system comprising a plurality of grids of a conducting material.

An emissive surface can herein also be understood to mean a main surface on which one or more punctiform emitters or field emitters are arranged or in which pits are provided from which the emission takes place.

The invention also relates to a method of manufacturing such an electron-optical system and to a method of securing this system in a vacuum tube.

A vacuum tube in which an electron beam is deflected through an angle of 90° over a very short distance (several mm) is proposed in the simultaneously filed Application No. PHN 12.047. Such a deflection cannot be realized with the conventional techniques.

It is an object of the invention to realise this possibility and to indicate measures with which an electron-optical system of very small dimensions can be manufactured, even if the said deflection is not strictly necessary.

SUMMARY OF THE INVENTION

To this end a vacuum tube according to the invention is characterized in that the electron-optical system comprises a plurality of pins of a conducting material and in that a grid is connected in an electrically conducting manner to at least one pin and is connected in an electrically insulating manner to at least one pin via a ceramic glass for the purpose of a mechanical connection.

The grid may be connected to one and the same pin, both in an electrically conducting manner and mechanically.

A preferred embodiment of a vacuum tube according to the invention in which the said deflection through 90° can be realized in characterized in that the electron-optical system for deflecting the electron beam comprises a first set of grids parallel to the emissive surface, at least a second grid extending at least partly perpendicularly to the emissive surface and at least two extra grids extending at least over a part of their surface at an angle of substantially 45° to the said first and second grids.

The use of the ceramic glass, for example a lithium aluminosilicate glass, provides the possibility of securing very small components together, while electrically conducting connections can be manufactured by means of a conducting glass. This provides the possibility of realising an electron-optical system for the deflection of the electron beam over a distance of approximately 2 mm.

Electrons leaving the emissive surface will generally first undergo an acceleration over a small distance, perpendicularly to the emissive surface. The plane in which the deflected beam moves will therefore be generally located at a distance of 2–6 mm from the emissive surface.

A further preferred embodiment of a vacuum tube according to the invention is characterized in that the extra grid which is farthest away from the emissive surface is provided with an aperture facing said surface.

Through such an aperture, which may be provided with a gauze of conducting material in order to prevent perturbation of the electric field, the emissive surface can be coated with cesium or another work-function decreasing material from a source located outside the electron-optical system.

In certain embodiments different grids may also be interconnected in an electrically conducting manner.

A method of manufacturing the electron-optical system is characterized in that an assembly of grids mutually separated by spacers is secured to the pins by means of a ceramic glass material and in that the ceramic glass is subsequently cured, the spacers being removed after curing of the ceramic glass and apertures being provided in the grids.

BRIEF DESCRIPTION OF THE DRAWINGS

The invention will now be described in greater detail by way of example with reference to the accompanying drawings in which.

The Figures are not to scale; corresponding components generally have the same reference numerals.

DESCRIPTION OF THE PREFERRED EMBODIMENTS

Figure 1:
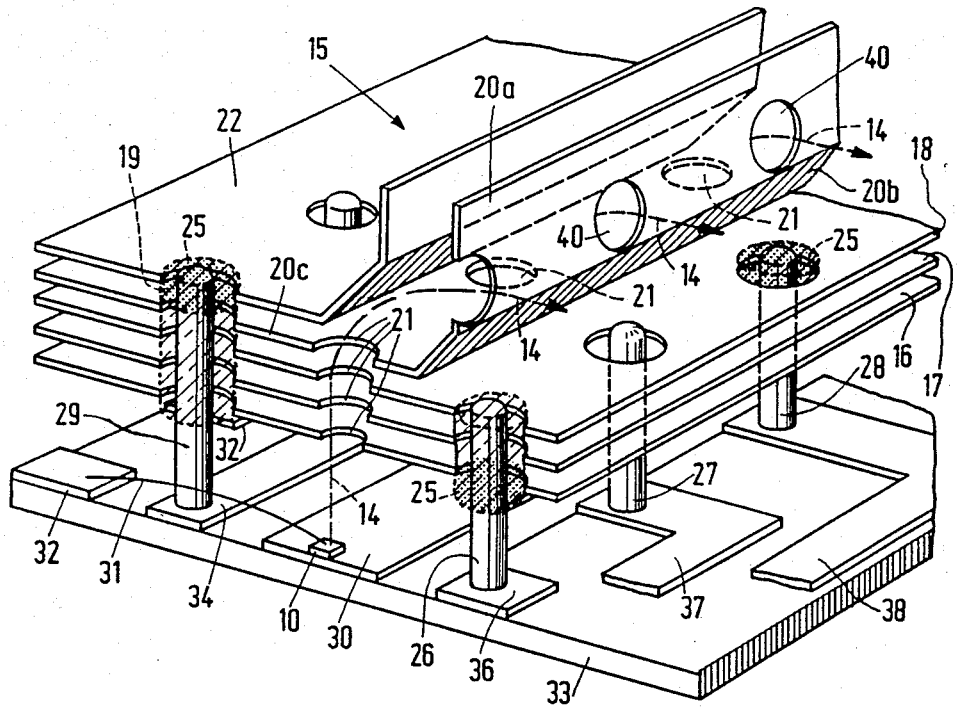
FIG. 1 is a diagrammatic elevational view of a part of a vacuum tube according to the invention, particularly the electron-optical system.

FIG. 1 shows diagrammatically a part of a vacuum tube according to the invention, particularly a part of the electron-optical system 15. A plurality of semiconductor cathodes 10 (only one of which is shown in FIG. 1) is secured to a common electrode 30. In this embodiment semiconductor cathodes of the reverse biassed junction type as described in U.S. Pat. No. 4,303,930 and its divisional counterpart U.S. Pat. No. 4,370,797 are used, either with or without the acceleration electrode described in said Application. The electrode 30 contacts the p-type substrate of the semiconductor body, while the n-type surface zones are contacted through connection wires 31 which connect them in an electrically conducting manner to connection conductors 32. Signals for modulating the electron beams emitted by the cathodes 10 are presented through these connection conductors 32. The conductor tracks 30, 32 are provided on an electrically insulating support 33, for example a glass plate which, if necessary, may simultaneously function as the rear wall of the vacuum tube.

The electron-optical system 15 comprises a plurality of grids 16, 17, 18 which are mechanically connected to pins 26, 27, 28 by means of a connection 19 of ceramic glass (or devitrifying glass). Such a connection 19 may connect a plurality of grids to one and the same pin.

The grids 16, 17, 18 receive the desired electrical voltage by connecting them through an electrically conducting connection to one or more of the pins 26, 27, 28 which consist entirely or at least on the outer side of an electrically conducting material. The electrically conducting connection can be obtained by means of a conducting glass. In the relevant embodiment the grids 16, 17, 18 are connected in an electrically conducting manner to the pins 26, 27, 28, respectively, by means of a conducting glass connection 25. The grids 16, 17, 18 have of course apertures 21 to pass the electron beams 14.

An extra grid 22 is connected in an electrically conducting manner through a similar conducting glass connection 25 to the pin 29 which in turn is connected in an electrically conducting manner to a connection conductor 34. A grid 20 is also mechanically connected to the pin 29 through a ceramic glass connection 19 which also connects the grids 16, 17, 18 to the pin 29 in a mechanical manner.

Figure 2:
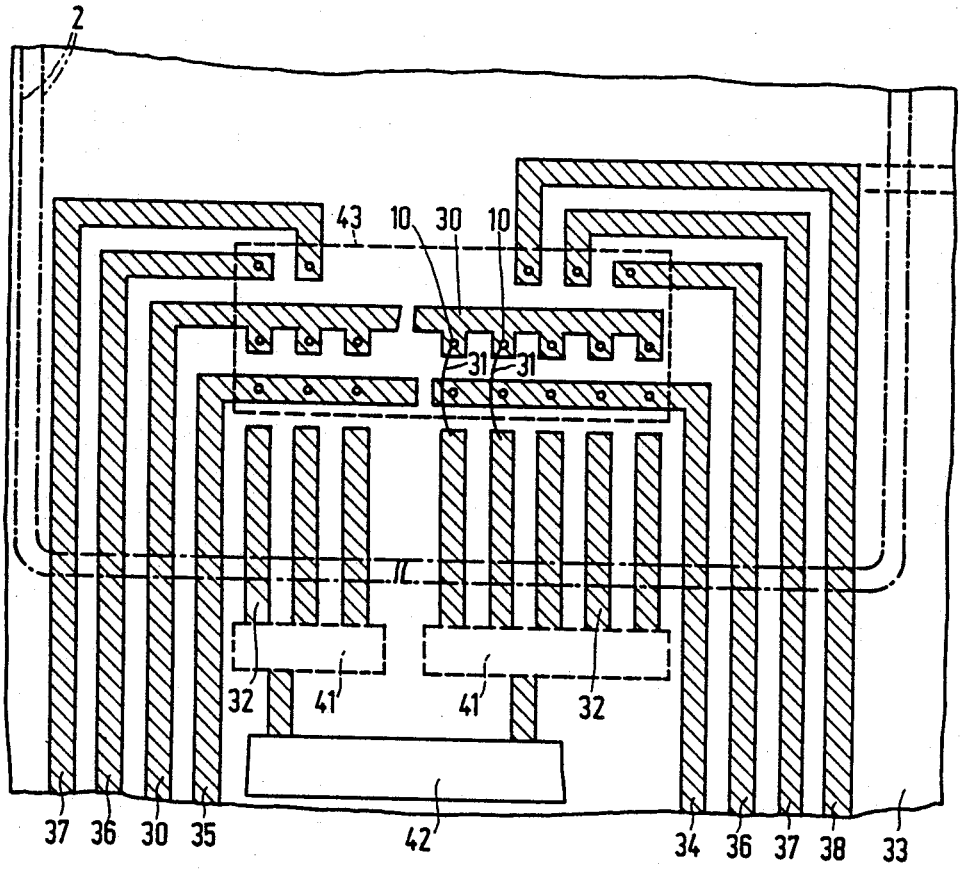
FIG. 2 shows diagrammatically a pattern of connections for this electron-optical system and the associated cathodes.

In addition to a part 20*a* provided with apertures 40 for passing the deflected electron beams 14, the grid 20 comprises an obliquely extending part 20*b* and a part 20*c* parallel to the grids 16, 17, 18. In a manner similar to the grid 22, the grid 20 may be connected in an electrically conducting and mechanical manner to pins 29 which may be mechanically connected or not connected to grids 16, 17, 18, 22. These pins provide the electrical contact of the grid 20 with connection conductors 35 (see FIG. 2). FIG. 2 shows in a plan view the connection conductors 36, 37, 38 for the grids 16, 17, 18 (connected in an electrically conducting manner to the connection conductors through the pins 26, 27, 28). The plan view of FIG. 2 also shows diagrammatically the control circuits 41 which provide the modulation voltages on the cathodes 10 and which in turn are controlled by a control unit 42. The connection conductors 34, 35, 36, 37, 38 are connected to voltage sources (not shown) for the purpose of supplying the desired acceleration and/or deflection potential.

In the plan view of FIG. 2 the broken line 43 shows the location of the electron-optical system 15 while the dot-and dash lines 2 indicate the location where an envelope, for example a glass cap can be secured on the support 33 to define a vacuum space. The cathodes 10 and the electron-optical system 15 are then within the vacuum envelope.

By using semiconductor cathodes and ceramic glass the dimensions realized may be very small. In this embodiment the distance between the grids 16, 17, 18 is, for example approximately 0.1 mm, while the distance between the emissive surface of the cathode 10 and the grid 16 is approximately 0.2 mm. The distance between the grids 20 and 22 is approximately 0.4 mm, while the grids themselves have a thickness of approximately 100–300 μm. The axis of the apertures 40 is located at a height of approximately 3.5 mm so that the electron beam 14 leaving the emissive surface can be deflected by means of the electron-optical system 15 (when using the correct voltages on the grids) towards a plane at a distance of less than approximately 6 mm from the emissive surface, which is very satisfactorily usable in thin flat display devices as described in the simultaneously filed application Ser. No. 156,491, No. PHN now allowed.

Figure 3:
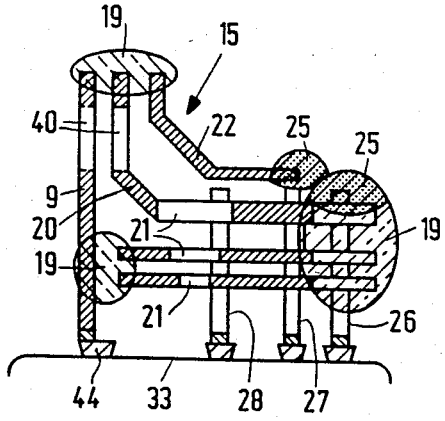
FIG. 3 is a diagrammatic cross-section of a further embodiment of the electron-optical system.

FIG. 3 is a diagrammatic cross-section of a further embodiment of an electron-optical system 15 for only one electron beam. The pins 26, 27, 28, 29 may then be arranged around the cathode (not shown in this Figure). The grids are again mechanically connected to the pins by ceramic glass connections 19 and the pins are connected in an electrically conducting manner to one of the grids by an electrically conducting glass connection 25. To provide the grids with voltages through the pins 26, 27, 28, 29 the pins may be soldered onto connection conductors, for example by means of conducting glass. It is alternatively possible to use an IC-base instead of the glass 33, with the pins being secured to the lead-throughs, while the required voltages are then applied to the IC-pins. In the relevant embodiment the electron-optical system 15 has an extra second grid 9 for acceleration in a direction parallel to the emissive surface. Otherwise the reference numerals have the same significance as those of the previous Figures. In order to eliminate possible distortions in the electron beam after deflection through 90°, generally known preventive methods can be used such as, for example providing a four-pole field. This can be realised, for example, by providing extra electrodes around one of the apertures in the electrodes 9, 20.

Figure 4A:
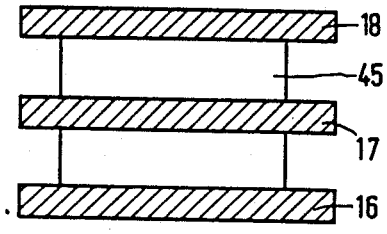
FIGS. 4*a, b* and *c* show diagrammatically a part of the electron-optical system during stages of manufacture
Figure 4B:
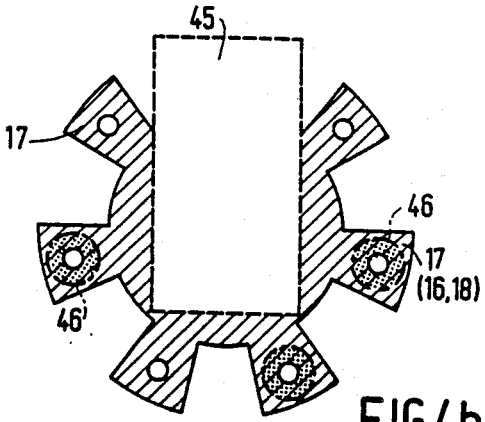
Figure 4C:
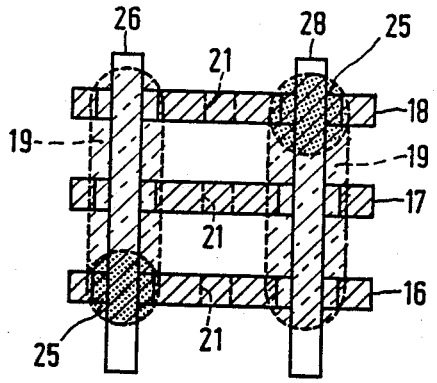

FIG. 4 shows diagrammatically how such an electron-optical system 15 according to the invention can be obtained. The starting point (shown in a side elevation view in FIG. 4*a*) is a plurality of grids 16, 17, 18 which are kept together by means of spacers 45, for example by means of a clamping spring. The shape of the grids 16, 17, 18 and the spacers 45 is shown in a plan view in FIG. 4*b*. The assembly thus obtained is slid on pins 26, (27,) 28 (FIG. 4*c*) for which purpose the grids have apertures 46. Subsequently a ceramic connection 19 is established, in this embodiment by means of, for example a lithium aluminosilicate glass. After curing at 445° C. this glass is crystallized enabling subsequent process steps at higher temperatures such as, for example providing electrical contacts and conducting glass connections 25. After curing, however, the spacers 45 are first removed by releasing the clamping spring, whereafter the apertures 21 can be provided in the grids 16, 17, 18 by means of, for example spark erosion or laser cutting. Subsequently, the electrically conducting connections 25 are provided, for example at 500° C. In the relevant embodiment each pin is connected to all grids by ceramic glass 19, but this is not strictly necessary. A mechanical and an electrically conducting connection per grid, which may coincide, may suffice.

In the manufacture of the electron-optical system according to FIGS. 1 to 3 similar manufacturing steps are used, although other auxiliary means are now required for keeping the grids and spacers together (which means exert a cleamping force in two mutually perpendicular directions), while the apertures 21, 40 must also be provided in two mutually perpendicular directions.

Figure 5:
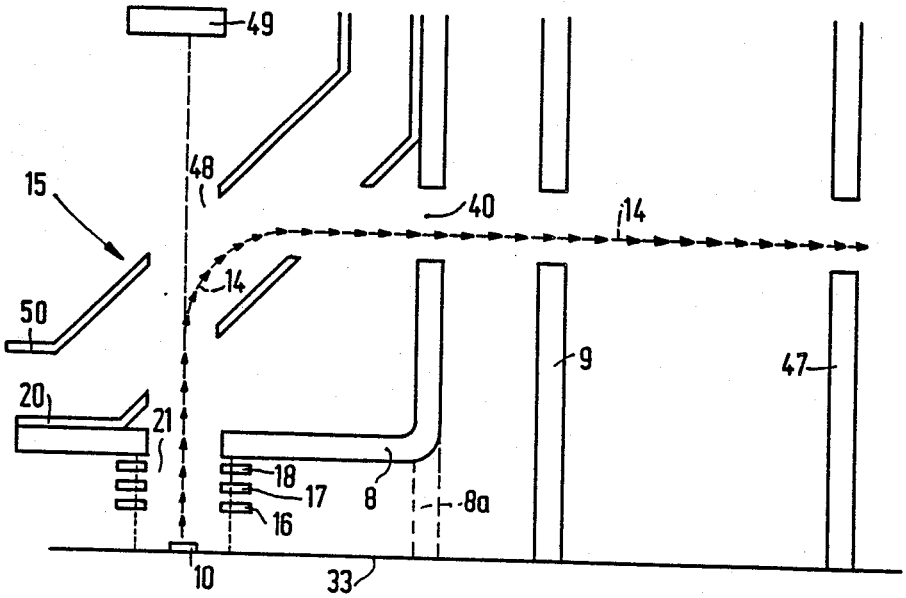
FIG. 5 shows diagrammatically a further variant.

Finally, FIG. 5 is a cross-section of an electron-optical system 15 for a device according to the invention in which an aperture 48 is provided in the extra grid 50. If necessary, cesium (or another work-function decreasing material) may be vapour-deposited through this aperture from a source 49 onto the emissive surface of the cathode 10. To prevent possible perturbation of the electric field through such an aperture, it is preferably provided with a gauze (not shown).

Furthermore the auxiliary electrode 20 is connected in an electrically conducting manner at two locations by means of auxiliary piece 8 which has therefore the same potential and, if necessary, can be connected to the support 33 by a pin 8*a* shown in phantom and connection tracks.

For the sake of completeness a high-voltage grid 47 is also shown. The electron beam 14 was deflected through 90° with the voltages and mutual distances as stated in Table 1.

TABLE 1

| Distance | | Voltage | |
|---|---|---|---|
| Emissive surface - grid 16 | 0.2 mm | Emissive surface | 0 V |
| Grid 16, 17, 18 mutually | 0.1 mm | Grid 16 | −6 V |
| Distance 50–20 | 1.0 mm | Grid 17 | +40 V |
| Distance 8–9 | 2.0 mm | Grid 18 | +10 V |
| Centre line 21-vertical part 8 | 3.0 mm | Grid 50 | 0 V |
| Centre line 40-horizontal part 8 | 3.0 mm | Grid 20 | +20 V |
| | | Grid 9 | +100 V |

The invention is of course not limited to the embodiments shown, but several variations are possible within the scope of the invention. For example, the electron beams can be deflected through angles other than 90°; if a short lifetime is not objectionable, the electron-optical system shown (notably FIG. 4) can be used for an electron beam which moves perpendicularly to the emissive surface. Several other choices are also possible for the different types of semiconductor cathodes such as, for example the cathodes described in U.S. Pat. Nos. 4,516,146, 4,506,284 and in U.S. patent application Ser. Nos. 021,937 and 021,938, filed Mar. 5, 1987.

What is claimed is

1. A method of manufacturing an electron-optical system for a vacuum tube provided with at least one semiconductor cathode supported on an insulating plate and having an emissive surface for emitting electrons and an electron-optical system for deflecting at least one electron beam emitted by the surface comprising a plurality of spaced apart grids of a conducting material, and a plurality of spaced apart electrically conducting pins secured to said plate, characterized in that an assembly of at least some of the grids mutually separated by spacers is secured to the pins by means of a ceramic glass material and in that the ceramic glass is subsequently cured, the spacers being removed after curing and apertures being provided in the grids.

2. A method of manufacturing an electron-optical system for a vacuum tube as claimed in claim 1, characterized in that a first and a second assembly of grids mutually separated by spacers are secured to the pins by means of a ceramic glass connection, the axis of the first and second assemblies extending substantially perpendicularly with respect to each other, in that the spacers are removed after curing of the ceramic glass and in that apertures are provided in the grids.

3. A method as claimed in claim 2, characterized in that at least one outer extra grid is also provided, extending over at least a part of its surface at an angle of substantially 45° to the first and second assembly of grids, and in that the extra grid is provided with an aperture.

4. A method as claimed in claim 3, characterized in that the aperture in the outer extra grid is provided with a gauze of electrically conducting material.

5. A method as claimed in claim 1, characterized in that the assemblies are kept together by means of a clamping spring during connection and curing.

6. A method as claimed in claim 1, characterized in that the apertures are provided by means of spark erosion or laser cutting.

7. A method as claimed in claim 1, characterized in that ceramic, mica, silicon or eloxated aluminium plates are used as spacers.

8. A method as claimed in claim 1, characterized in that the pins are secured by means of a silver-glass solder to connection points for the electron-optical system.

9. A method as claimed in claim 8, characterized in that during the same silver-glass soldering step the electrically conducting connections are provided between grids and pins.

* * * * *